US008020256B2

(12) United States Patent
Goller et al.

(10) Patent No.: US 8,020,256 B2
(45) Date of Patent: Sep. 20, 2011

(54) PIVOT DEVICE

(76) Inventors: Hans-Peter Goller, Remscheid (DE); Richard Morawetz, Wuppertal (DE)

( * ) Notice: Subject to any disclaimer, the term of this patent is extended or adjusted under 35 U.S.C. 154(b) by 483 days.

(21) Appl. No.: 12/280,191

(22) PCT Filed: Feb. 9, 2007

(86) PCT No.: PCT/DE2007/000255

§ 371 (c)(1),
(2), (4) Date: Aug. 21, 2008

(87) PCT Pub. No.: WO2007/095896

PCT Pub. Date: Aug. 30, 2007

(65) Prior Publication Data

US 2009/0056076 A1 Mar. 5, 2009

(30) Foreign Application Priority Data

Feb. 22, 2006 (DE) ..... 10 2006 008 525
Apr. 8, 2006 (DE) ..... 10 2006 016 670

(51) Int. Cl.
*E05D 11/08* (2006.01)

(52) U.S. Cl. ..... 16/342; 16/334

(58) Field of Classification Search ..... 016/250, 016/251, 387, 380, 388, 342, 330, 303, 50, 016/54, 334, 344; 49/397, 399, 381, 388; 312/329, 326, 405, 401; 296/146.11, 146.12
See application file for complete search history.

(56) References Cited

U.S. PATENT DOCUMENTS 1,956,040 A 4/1934 Meyer
2,047,909 A * 7/1936 North ..... 16/250
2,584,283 A * 2/1952 Oliver et al. ..... 248/158
2,585,836 A * 2/1952 Quigley ..... 16/250
3,675,271 A * 7/1972 Fellwock et al. ..... 16/265
3,837,042 A * 9/1974 White ..... 16/339
4,186,905 A * 2/1980 Brudy ..... 248/478
4,570,291 A * 2/1986 Smith et al. ..... 16/250
4,825,508 A * 5/1989 Post, Jr. ..... 16/250
4,958,877 A * 9/1990 Lezotte et al. ..... 296/65.17
5,272,789 A * 12/1993 Mitchell et al. ..... 16/291
5,292,171 A * 3/1994 Harrell ..... 297/113
5,333,356 A * 8/1994 Katagiri ..... 16/340
5,362,131 A * 11/1994 Susko et al. ..... 297/463.1
5,572,768 A * 11/1996 Daul ..... 16/49
5,715,576 A * 2/1998 Liu ..... 16/342
6,152,554 A * 11/2000 Parisi ..... 312/405
6,314,614 B1 * 11/2001 Kuehl ..... 16/342
6,349,449 B1 2/2002 Kuehl (Continued)

FOREIGN PATENT DOCUMENTS

DE 19600553 C1 * 6/1997

(Continued)

*Primary Examiner* — Chuck Y. Mah
(74) *Attorney, Agent, or Firm* — Gudrun E. Huckett

(57) ABSTRACT

A pivot device has a first hinge part and a second hinge part pivotably connected to the first hinge part about a pivot axis. A blocking device secures the first and second hinge parts in a pivoted position relative to one another against backward and forward pivoting out of the pivoted position. The blocking device has first and second friction surfaces that, when pivoting the first and second hinge parts relative to one another, glide across one another and move axially relative to one another in an axial direction of the pivot axis as a pivot angle between the first and second hinge parts increases.

14 Claims, 6 Drawing Sheets

U.S. PATENT DOCUMENTS

| | | | | |
|---|---|---|---|---|
| 6,854,161 | B2 * | 2/2005 | Lee | 16/50 |
| 7,261,272 | B2 * | 8/2007 | Courbon | 248/475.1 |
| 7,506,407 | B2 * | 3/2009 | Ishiwata | 16/340 |
| 2002/0078526 | A1 * | 6/2002 | Kincaid | 16/250 |
| 2002/0112319 | A1 * | 8/2002 | Kida | 16/342 |
| 2010/0192328 | A1 * | 8/2010 | Scheck et al. | 16/342 |

FOREIGN PATENT DOCUMENTS

| | | | | |
|---|---|---|---|---|
| DE | 19833924 | A1 | | 2/2000 |
| DE | 102005008214 | B3 | | 3/2006 |
| JP | 11083293 | A | * | 3/1999 |
| WO | 20050031097 | A1 | | 4/2005 |

* cited by examiner

Fig.3
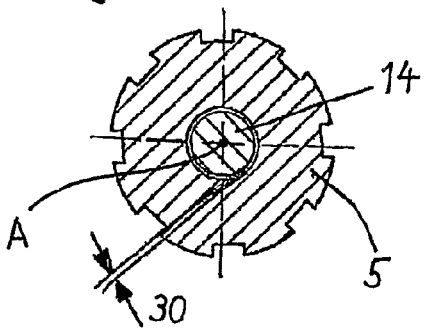
Fig.4
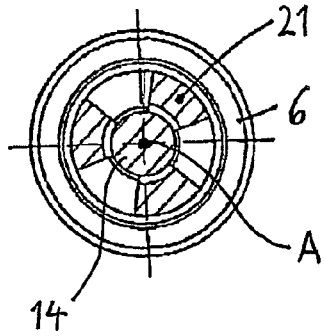
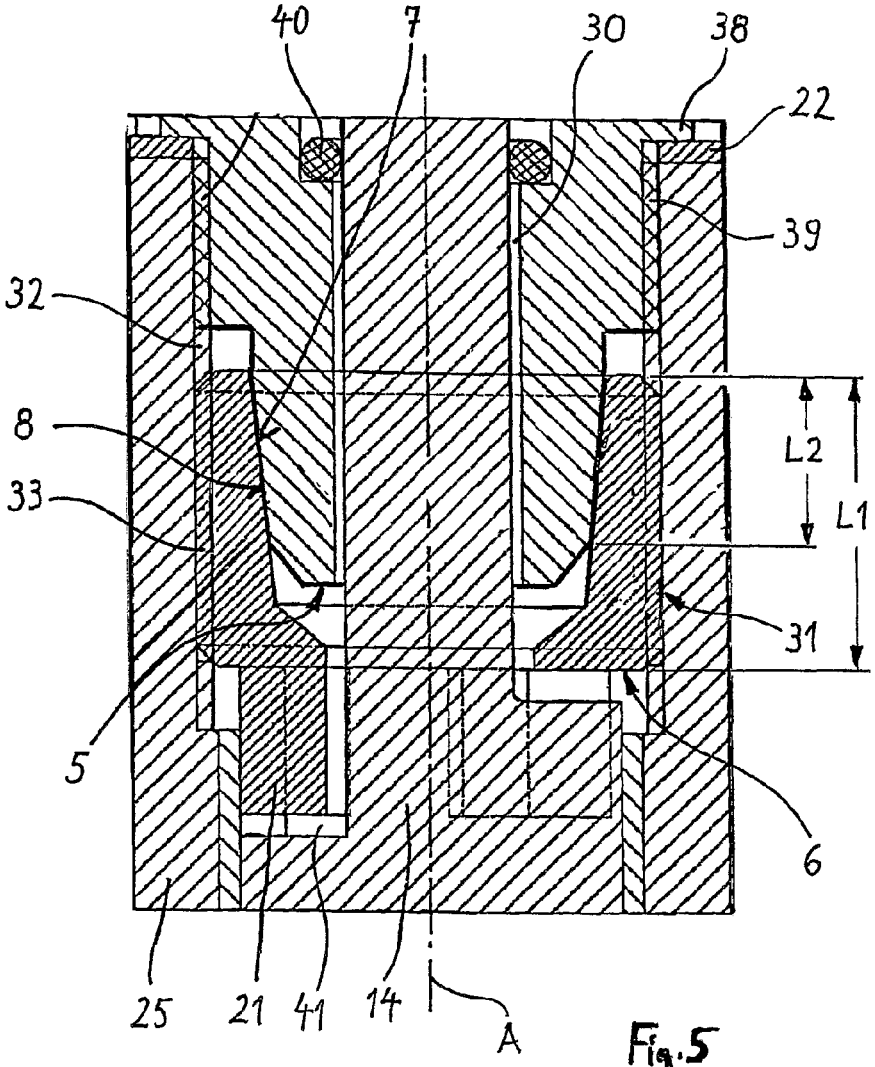
Fig.5

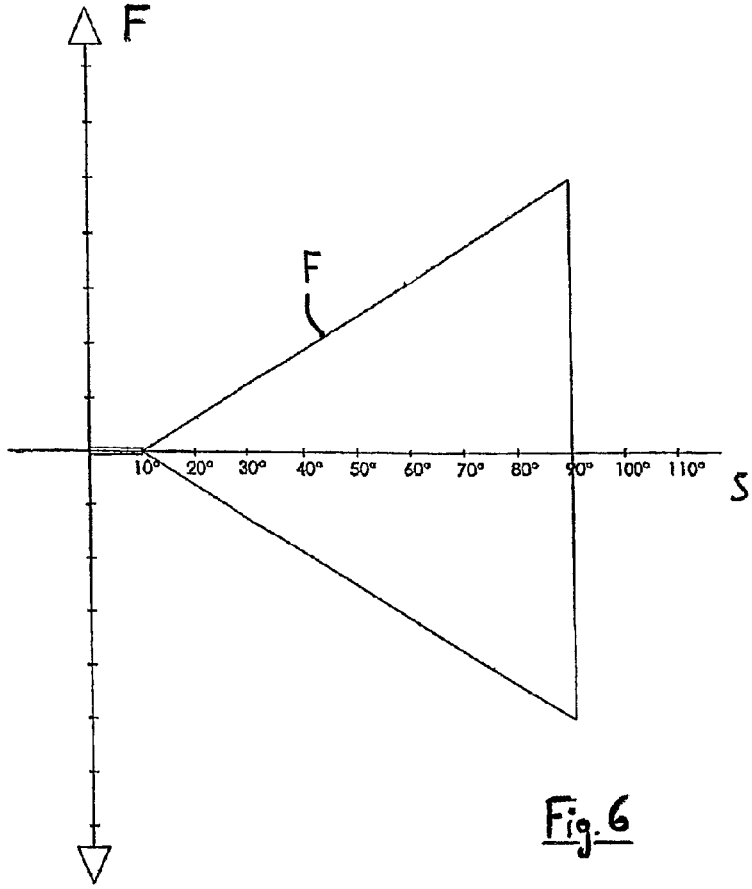
Fig. 6
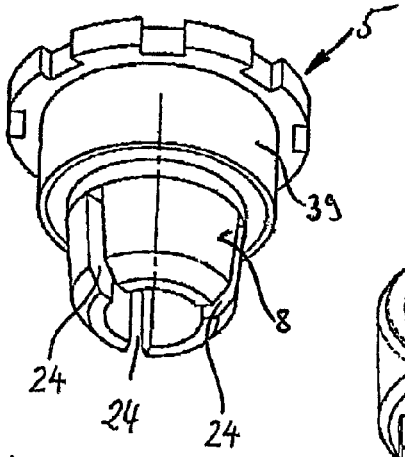
Fig. 7
Fig. 8
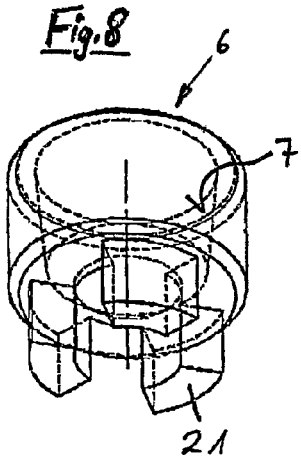
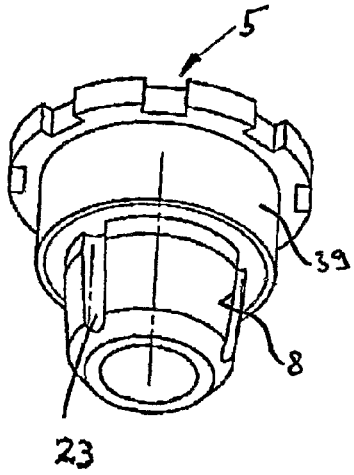
Fig. 9

PIVOT DEVICE

BACKGROUND OF THE INVENTION

The invention concerns a pivot device comprising a first hinge part, a second hinge part that is pivotable relative to the first hinge part about a pivot axis, and a blocking device that secures the hinge parts with regard to forward and backward pivoting.

WO 2005/031097 A1 discloses a pivot device with two hinge parts and a correlated blocking device. It serves for pivotably connecting vehicle doors to the body of a motor vehicle. The first hinge part as a door hinge part is secured on the vehicle door and the second hinge part as a body hinge part is secured on the motor vehicle body so that upon opening of the vehicle door the two hinge parts pivot relative to one another. The hinge is provided with a blocking device. It includes a blocking path with several blocking contours that at certain pivot angles of the door hinge part causes blocking by means of a correlated blocking member. Unwanted pivot movements of the hinge parts or unwanted opening or closing of the vehicle door are inhibited in this way. Only upon application of a preset pivoting force is it possible to release the door from the blocking action.

A further pivot device provided with a blocking device is disclosed in DE 198 33 924 A1. In this connection, the two hinge parts are connected by a relatively long screw bolt. It is seated with its head fixedly in the first hinge part and engages with its thread a corresponding thread of the second hinge part. Pivoting of the hinge parts relative to one another causes axial expansion of the screw bolt. This has the result that friction surfaces on the first and second hinge parts, between which a disk-shaped bearing plate is arranged, rub against one another with increasing normal force so that a blocking action will result that increases with the pivot angle. In operation, the friction surfaces that are positioned transversely to the hinge axis and the bearing plate are exposed to a significant surface pressure that causes great wear. This can lead over time to discontinuities in the initially uniformly increasing blocking action over the course of extended use.

A pivot device with a blocking action that operates in the circumferential direction is disclosed in DE 197 26 536 A1. In this device, the two hinge parts are provided with bushings inserted into one another and rotatable relative to one another. The inner surface of the outer bushing and the outer surface of the inner bushing that is formed by the hinge bolt are provided with slightly cam-shaped friction contours that are oversized relative to one another across part of the circumference. The outer bushing is therefore designed to be deformable. In spite of this, as a function of the pivot angle, individual surface areas of the friction contours are pressure-loaded much more than other surface areas. The non-uniform surface pressure causes increased local wear. This, over time, can lead to an increasingly undefined blocking action.

It is therefore the object of the invention to provide a pivot device comprising a blocking device which pivot device, even after an extended period of operation, still operates with a defined blocking action.

SUMMARY OF THE INVENTION

This object is solved for a pivot device of the aforementioned kind in that the blocking device has two friction surfaces that glide across one another as the hinge parts pivot and, with increasing pivot angle, move axially relative to one another.

With such a pivot device, an anti-pivot securing action is provided that operates reliably independent of the pivot angle. The hinge parts are secured by means of the blocking device in all angular positions, i.e., continuously, against backward and forward pivoting so that, for example, in case of a motor vehicle door the space available adjacent to the vehicle can be effectively utilized. By means of the axially occurring movement of the friction surfaces relative to one another, the friction force acting between the hinge parts increases uniformly in that with increasing pivot angle of the hinge parts a steadily increasing blocking action is achieved. The blocking device operates even after extended use with a reproducible effect without discontinuities of the blocking force being observed for the pivot angle-dependent increase of the blocking force. Sudden loads of the hinge parts are prevented even for extended service life.

Advantageously, the pivot device has a screw drive that moves the friction surfaces axially relative to one another. The spiral relative movement enables transformation of the pivot movement of the hinge parts into an axial movement of the friction surfaces along the pivot axis of the hinge parts in a constructively simple way.

For a simple configuration of the pivot device it is advantageous in this connection that the drive comprises a thread that is fixedly secured on the first hinge part and a matching thread that is stationary relative to the second hinge part.

For obtaining a large thread length and thus a smooth and canting-free thread drive, an embodiment is advantageous in which in the longitudinal direction of the hinge the drive extends across a first length section and the friction surfaces extend across a second length section and the length sections overlap one another partially in the longitudinal direction of the hinge.

It is moreover proposed that one friction surface is fixed relative to the second hinge part and that the other friction surface is fixed relative to the first hinge part.

In this connection, it is advantageous when one friction surface is axially movable and the other friction surface is axially fixed. The movement of only one friction surface in the direction of a stationary second friction surface enables a simple configuration of the pivot device.

Advantageous for a simple and compact configuration is an embodiment in which one friction surface is an inner cone in which cone the other friction surface designed like a matching truncated cone will glide. For such a configuration the friction surfaces form a type of conical brake whose friction surfaces are particularly suitable for the friction increase in accordance to the invention by axial movement of the friction partners.

An embodiment is advantageous with respect to mounting technology in which the hinge parts together with the blocking device form a common assembly so that minimal expenditure is required for mounting the pivot device.

Moreover, an embodiment is proposed according to which one of the friction surfaces is provided on a brake member that is axially movable relative to the first hinge part as well as relative to the second hinge part. In turn, on the brake member one element of the drive is provided, i.e., one of the two threads. It is advantageous in this connection that the brake member is a sleeve with an inner wall and an outer wall and the friction surface is formed on one of the walls and the thread on the other one of the two walls. This makes it possible to design the drive with a thread having a large support length providing thus a smooth and canting-free screw drive.

In this connection, it is a constructive advantage when the brake member is connected by means of a pawl clutch to the second hinge part so that, as a whole, a simple and compact configuration of the pivot device results. Also, this configuration provides for a simple assembly of the brake member.

Moreover, an embodiment is proposed where the friction surfaces are formed on two separate sleeves. Should one of the friction surfaces be worn, the function of the pivot device can be reinstated in a simple way by exchange of one or both sleeves.

An embodiment is advantageous wherein the sleeve provided with the truncated cone-shaped friction surface has axial grooves or axial slots distributed about its circumference. By means of the axial grooves or axial slots the elasticity of the truncated cone-shaped sleeve is increased so that it is yielding in the radial direction and can be compressed with regard to the diameter. By means of the size and/or number of axial slots or grooves the increase of the friction force for pivoting the hinge parts can be varied so that the characteristics of the pivot device can be adjusted in accordance with e.g. the special requirements in automobile construction.

An embodiment is moreover advantageous in which one of the sleeves relative to the second hinge part is fixedly secured and is movable in the axial direction in order to realize in this way the axial movement of the friction surfaces.

For a compact configuration it is advantageous when the sleeves are arranged in a cylindrical opening of the first or second hinge part.

Finally it is proposed that the first hinge part is a door hinge part, the second hinge part is a body hinge part, and the blocking device is a door catch for arresting a vehicle door relative to the body of a motor vehicle. In particular, in case of motor vehicle doors a device that inhibits continuously a return movement of the vehicle door is advantageous in order to be able to optimally utilize the space for getting in and out of the car. The pivot angle-dependent increase of the friction force is also advantageous because, for example, in case of a greatly sloping roadway and vehicle doors that are wide open, there are often greater forces acting on the door than in the case of minimal opening angles. The friction force increase also prevents a sudden load acting on the body hinge part or the body part connected to it, for example, a vehicle pillar.

BRIEF DESCRIPTION OF THE DRAWINGS

Further details and advantages of a pivot device according to the invention will be explained in the following with the aid of the attached drawings in which:

FIG. 3 a section illustration of the section plane indicated in FIG. 2 at III-III;

FIG. 4 a section illustration of the section plane indicated in FIG. 2 at IV-IV;

FIG. 5 an enlarged detail illustration of the detail indicated in FIG. 2 at V;

FIG. 6 a diagram illustrating the dependency of the friction force or the brake momentum and the pivot angle;

FIG. 7 a sleeve with friction surface of a truncated cone shape;

FIG. 8 a sleeve with inner conical friction surface;

FIG. 9 a further sleeve with friction surface of a truncated cone shape;

DESCRIPTION OF PREFERRED EMBODIMENTS

In FIGS. 1 to 9 and 10 to 14 embodiments of a pivot device according to the invention for pivotally connecting vehicle doors to the body of a motor vehicle are illustrated. The invention is however not limited to a pivot connection of motor vehicle doors but can also be used in other fields of technology in any case where two components must be connected to one another pivotably in the manner of a hinge connection and where a continuously operating blocking action of the pivot movability is desired. For example, the pivot device can be used for front doors or windows, for example, in order to prevent that wind will slam the door or window shut. Also, e.g. in the case of domestic trash containers the device can be used in order to hold the lid in the open position when filling trash into the trash container.

Figure 1:
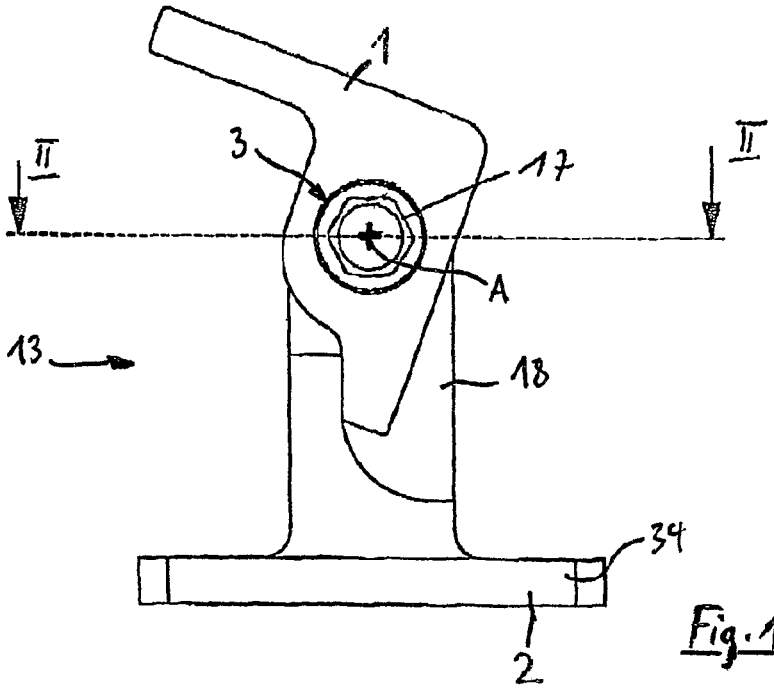
FIG. 1 shows a plan view onto a pivot device according to the invention in accordance with a first embodiment of the invention.

As can be seen in the illustration of FIG. 1, the pivot device according to the invention has two hinge parts 1, 2 that are pivotable relative to one another about pivot axis A. The first hinge part 1 is a door hinge part to which the door of a motor vehicle can be attached while the second hinge part 2 is a body hinge part that is connected by means of flange 34 to the body of the motor vehicle. Between the two hinge parts 1, 2 a blocking device 3 is arranged that inhibits undesired pivot movements of the hinge parts 1, 2. In the open position, the door is held in position by the blocking device 3 such that it can be opened farther or closed only against a certain resistance.

Figure 2:
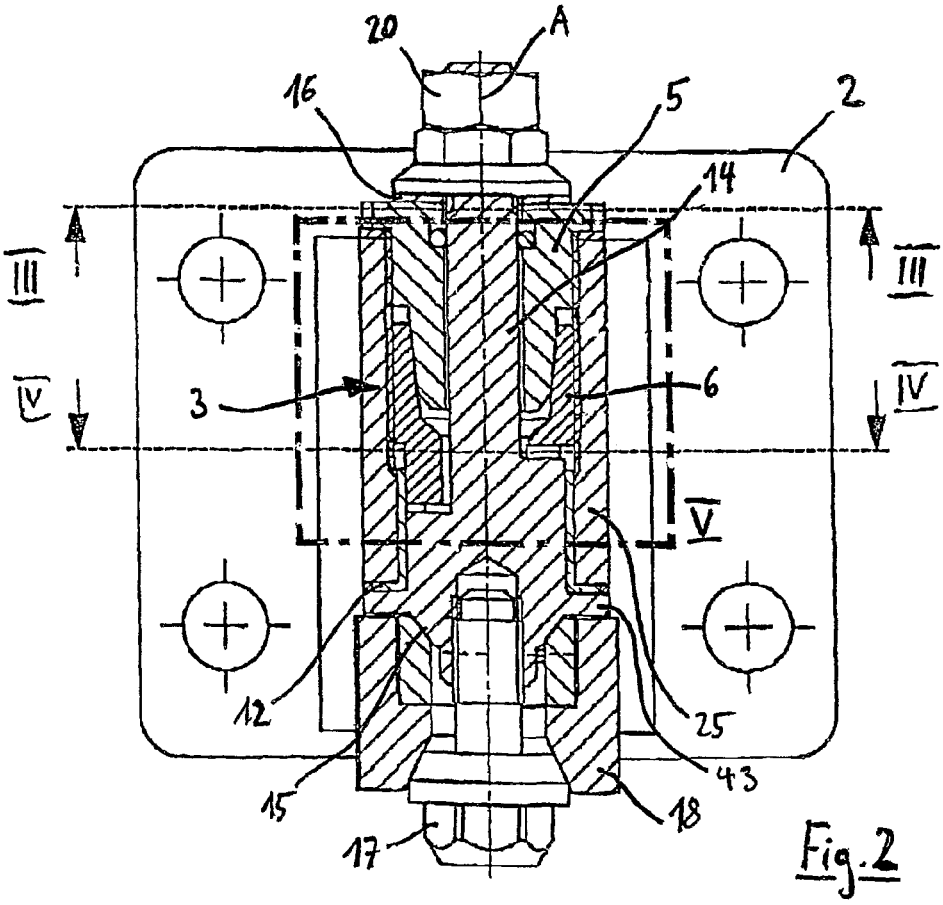
FIG. 2 a section illustration in accordance with the section plane indicated in FIG. 1 at II-II.

The blocking device 3, as can be seen in the illustration of FIG. 2, can be integrated into a housing 25 of the hinge part 1 that serves as a hinge bearing or into a housing 18 of the second hinge part 2 so that the pivot device as a whole can be mounted as an assembly 13.

In the first embodiment, in the interior of the housing 18 or 25 a hinge shaft 14 is provided that penetrates the two housings 18, 25 in the vertical direction and in this way clamps the hinge parts 1, 2 axially relative to another. The hinge shaft 14 is coupled at the lower end by means of the housing 18 fixedly to the second hinge part 2. For this purpose, the hinge shaft 14 is provided at its lower end with a threaded bore into which a screw 17 is screwed that clamps the hinge shaft 14 fixedly against surface 15. As a result of the anti-rotation connection with the body hinge part 2 the hinge shaft 14 does not follow the pivot movements of the first hinge part 1 or the housing 25 when opening or closing the vehicle door. The other end of the hinge shaft 14 passes through the opening of the housing 25 of the second hinge part 2. At the upper end the hinge shaft 14 is axially screw-connected by means of nut 20 and interposition of a glide plate 16 to the first hinge part 1. The hinge shaft 14 has moreover a radial collar 43 having at its bottom side a support surface resting against the end face of the housing 18. On the top side of the radial collar 43 an angled slide bushing 12 is arranged relative to which the housing 25 of the first hinge part 1 is rotatably supported.

In the interior of the housing 25 the essential elements of the blocking device 3 are provided. Components of the blocking device 3 are an inner conical sleeve 6 and a truncated cone-shaped sleeve 5 that, like a friction brake, inhibit the forward and return pivoting of the hinge parts 1 and 2. Details of the function of the blocking device 3 will be explained in more detail with the aid of the enlarged detail illustration of FIG. 5.

The sleeve 5 provided with a truncated cone-shaped friction surface 8 is axially fixed and secured against rotation in the opening of the housing 25 of the hinge part 1 so that it forms a type of braking rotor of the friction brake. The sleeve 5 is provided above its truncated cone-shaped friction surface 8 with an outer thread 39 (compare also FIGS. 7, 9) that is screwed into the inner thread 32 of the housing 25. At the upper end the sleeve 5 has a radial collar 38 that rests by means of annular seal 22 against the end face of the housing 25. By means of a further seal 40 the inner bore of the sleeve 5 is sealed relative to the inner rotating hinge shaft 14 so that at this location no lubricant can exit from the interior of the blocking device and no dirt or dust can penetrate into it. By means of the nut 20 that is screwed onto the upper end of the hinge shaft 14 the sleeve 5 is secured in the screwed-in position. Inasmuch as a securing means of the screw connection between sleeve 5 and housing 25 is not provided, the tightening torque of the screw connection should be greater than the greatest possible torque of the blocking device 3 so that an accidental release of the sleeve 5 from the housing 25 is reliably prevented.

The other sleeve 6 is provided at its inner wall with a friction surface 7 designed as an inner cone. This sleeve 6 is the brake member or brake anchor of the friction brake and is fixedly coupled by means of the hinge shaft 14 with the second hinge part 2 that is secured in the illustrated embodiment on the vehicle body. The rotation of the first hinge part 1 upon opening of the vehicle door is transformed by a screw drive 31, providing an axial forced guiding action for the brake member 6, into an axial movement of the brake body 6 so that the friction surfaces 7, 8 with increasing pivot angle of the hinge part 1 move toward one another or away from one another when the pivot angle decreases.

The drive 31 is comprised of two elements 32, 33 that determine its spiral movement. The first element is formed by the inner thread 32 of the housing 25 and the second element by a matching outer thread 33. This outer thread 33 is located on the wall of the sleeve-shaped brake member 6 facing away from the conical friction surface 7, i.e., in the illustrated embodiment on the outer wall of the brake member 6. In this way it is possible that the outer thread 33 extends across a relatively large length section of the brake member 6. This leads to an increase of the effective supporting length of the screw drive 31 with the result of a steady and canting-free drive action. Also contributing to this is the fact that in the longitudinal direction of the hinge the thread drive 31 extends across a first length section L1 and the friction surfaces 7, 8 across a second length section L2 wherein these two length sections 7, 8 partially overlap, i.e., they extend across a common length section.

When rotating the housing 25 about the axis A, the sleeve 6 acting as brake member moves in accordance with the thread pitch within the housing 25 in the upward direction toward the truncated cone-shaped friction surface 8 of the axially fixed sleeve 5 until between the two friction surfaces 7, 8 a friction force is generated that is oriented in the circumferential direction. Upon further pivoting of the hinge part 1 the sleeve 6 is moved by means of the screw drive 31 farther axially upwardly against the stationary sleeve 5 so that the inner conical surface 7 with increasing pivot angle is forced more strongly against the truncated cone-shaped friction surface 8 of the sleeve 5. As a function of this pressure, with increasing pivot angle an increase of the friction force between the friction surfaces 7 and 8 results so that accidental pivot movements of the hinge parts 1, 2 in any pivot position or open position of the door are reliably blocked. Expediently, this correlation is determined such that the pressing force or the friction force that depends on the pressing force, beginning at a completely closed door with increasing pivot or opening angle will increase monotonously. It is decisive in regard to this function that the sleeve 6 is axially movably constructed relative to the two hinge parts 1, 2 but is rotatable only with respect to one of the two hinge parts.

The friction force that exists between the surfaces 7 and 8 serves essentially as a holding force for the open vehicle door that inhibits further opening or closing of the vehicle door in a continuous fashion, i.e., in any pivot position. In the case of heavy vehicle doors several pivot devices for a door can be used in order to achieve in this way a satisfactory holding force, for example, in case of especially heavy truck doors. In addition to the illustrated embodiment with conical or truncated cone-shaped sleeves other geometries, for example, with elliptical cross-section are also conceivable.

For realizing the axial movability of the inner conical sleeves 6, the sleeve is provided at its bottom end with a pawl clutch whose individual pawls 21 (compare also FIG. 8) engage matching recesses 41 of the hinge shaft 14. As can be seen in the illustration of FIG. 4, the pawl clutch in the illustrated embodiment is comprised of a total of three pawls 21 distributed about the circumference of the hinge shaft 14. Of course, the clutch can also have more or fewer than three pawls. It can also be taken from the illustration of FIG. 5 that the sleeve 5 has a certain radial play 30 relative to the hinge shaft 14. In this way, the truncated cone 8 can be radially compressed when great forces are acting without the inner surface of the truncated cone 8 pressing against the hinge shaft 14; see also FIG. 3.

The interrelation between the pivot angle S and the friction force F or the brake torque of the blocking device 3 is schematically illustrated in FIG. 6. After overcoming an initial pivot angle of approximately 10° up to which angle opening of the door is not associated with any significant increase of the friction force F or the brake torque, the two friction surfaces 7, 8 will contact one another so that further pivoting of the hinge parts 1, 2 is realized with steady increase of the friction force F. By means of the friction force F the vehicle door is secured in its pivot position against forward and backward pivoting such that only after overcoming the friction force F the door can be closed or opened farther. The magnitude of the friction force increase as a function of the pivot angle S, i.e., the slope of the linear section in FIG. 6, depends e.g. on the thread pitch of the screw drive 31. Also, the friction force increase can be adjusted by the incline of the conical inner surface 7 or the truncated cone-shaped surface 8. Moreover, the friction force F can be adjusted by means of grooves 23 (see FIG. 9) provided in the truncated cone-shaped friction surface 8 of the sleeve 5 or continuous slots 24 (compare FIG. 7) for different applications.

For certain applications it can be advantageous to eliminate the initially provided friction force-free initial pivot angle or to provide it across a larger or smaller angle range. In case of motor vehicle doors an initial pivot angle of 10° without increase of friction force has been found to be advantageous because for smaller pivot angles getting in and out of the vehicle is impossible anyway and blocking of the return pivot movement is therefore not required.

The brake torque or the friction force F of the blocking device 3 must not necessarily follow the course illustrated in FIG. 7. Depending on the application, it is also possible to provide progressive or degressive courses by means of the invention.

Figure 10:
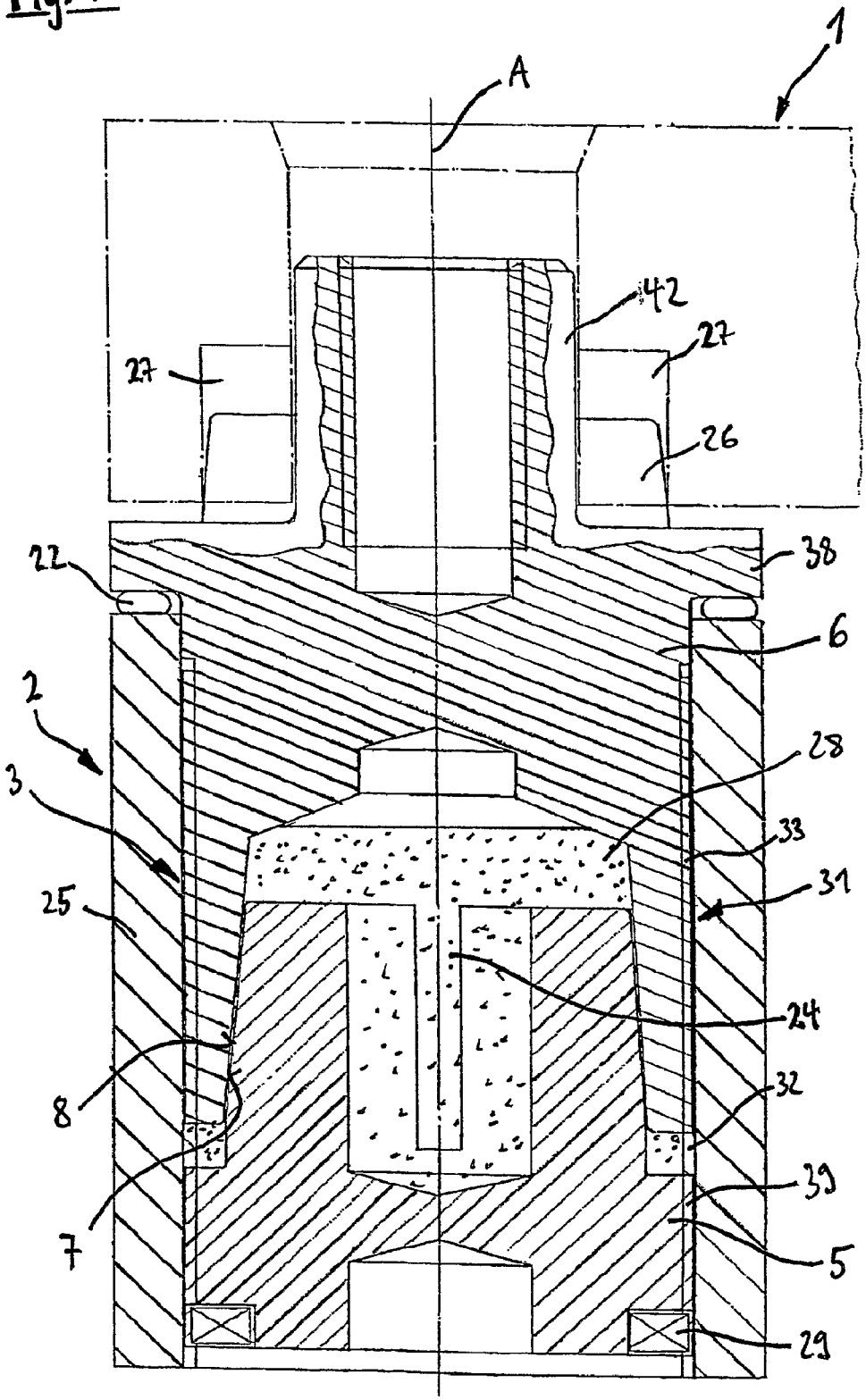
FIG. 10 an illustration of a pivot device according to a second embodiment of the invention in an illustration corresponding to the section II-II of FIG. 1.

A second embodiment of the pivot device according to the invention is illustrated in FIG. 10. The blocking device 3 is arranged again within the housing 25 of the second hinge part 2. In contrast to the described embodiment disclosed in connection with FIGS. 1 to 9 the pivot device illustrated in FIG. 10 has no continuous hinge shaft so that this embodiment is characterized by a simplified configuration in comparison to the first embodiment.

Figure 11:
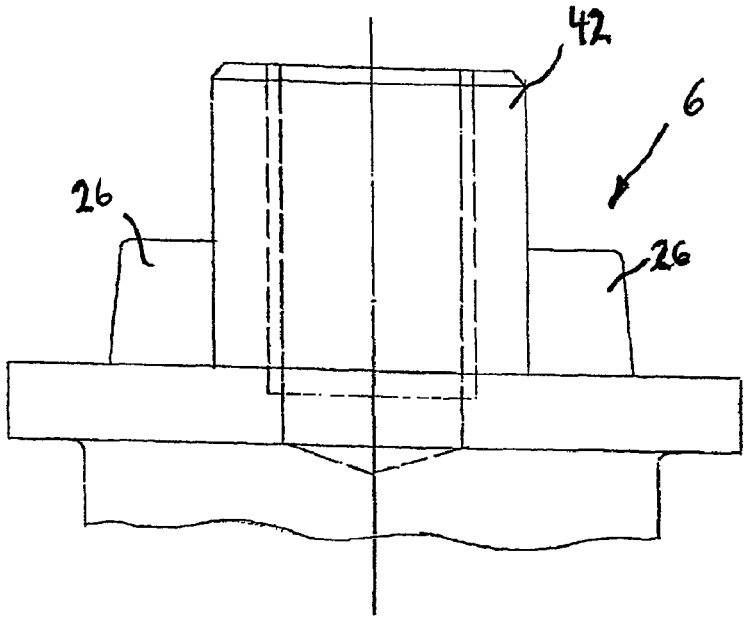
FIG. 11 a side view of the upper end of the inner conical sleeve of FIG. 10.
Figure 12:
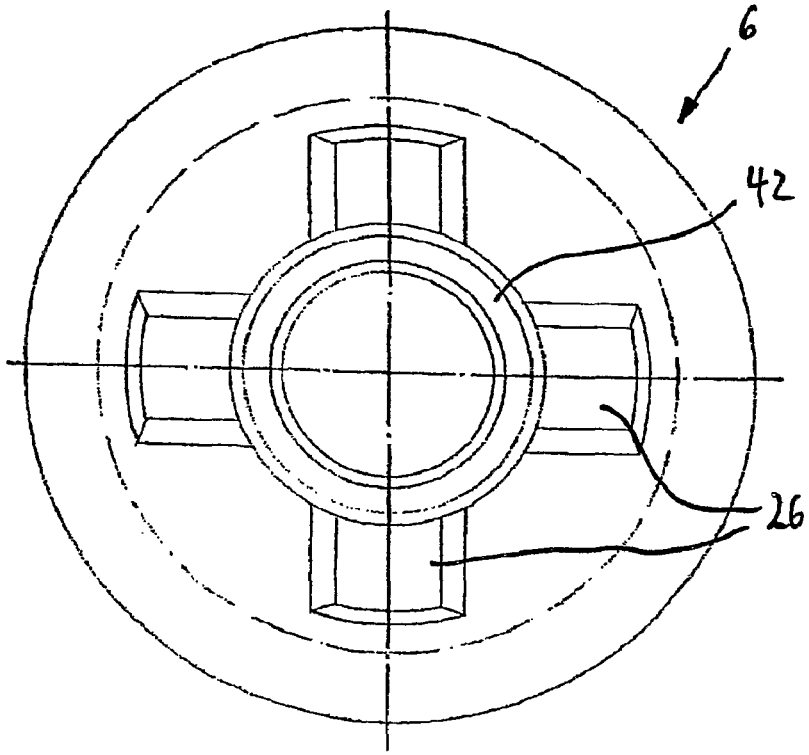
FIG. 12 an end view of the sleeve according to FIG. 11.
Figure 13:
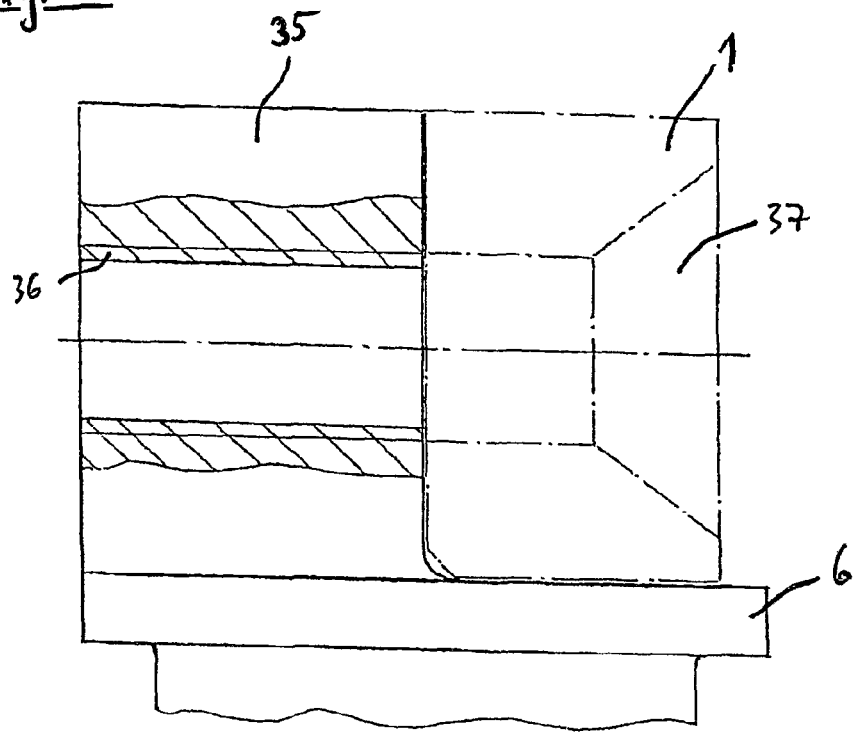
FIG. 13 a side view of the modified inner conical sleeve.
Figure 14:
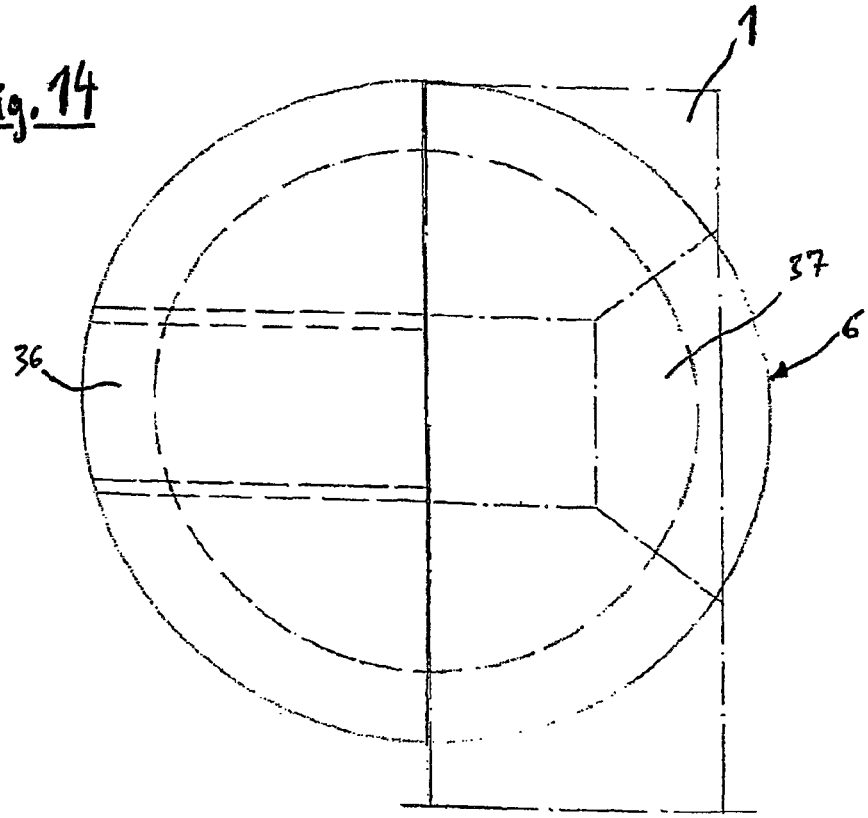
FIG. 14 an end view of the sleeve according to FIG. 13.

In the pivot device according to FIGS. 10 to 12, the inner conical brake member 6 has its upper end a pin 42. The first hinge part 1 is pushed in the direction of pivot axis A from above onto the pin 42 and is secured relative to the sleeve 6 against rotation by means of a total of four cams 26 provided in the illustrated embodiment (compare FIGS. 11, 12). For this purpose, the first hinge part 1 has at the bottom side recesses 27 that are engaged by the cams 26 of the sleeve 6 in a positive-locking way. In contrast to this, in the pivot device illustrated in FIGS. 13 and 14 the sleeve 6 has at the upper end a fastening section 35 with a threaded bore 36 that is arranged eccentrically to the pivot axis A. The first hinge part 1 is located laterally adjacent to the fastening section 35 and with its bore 37 is aligned and adjacent to threaded bore 36 so that the first hinge part 1 can be screw-connected to the fastening section 35 from the side and transversely to the pivot axis A; in this way, the sleeve 6 is connected to the hinge part 1 so as to be secured against rotation.

The operation of the pivot device illustrated in FIGS. 10 to 14 corresponds essentially to that of the preceding embodiment that has been explained in detail. Upon pivoting of the hinge part 1 the sleeve 6 rotates in the cylindrical housing 25 relative to the stationary sleeve 5. The stationary sleeve 5 is screwed below its conical friction surface 8 with an outer thread 39 into an inner thread 32 of the housing 25 and is anti-rotationally secured by means of a securing ring 29 so that the sleeve 5 can neither be rotated nor axially moved.

By means of the screw drive 31 the sleeve 6 is moved upon pivoting of the hinge part 1 about pivot axis A axially relative to the fixed sleeve 5. In contrast to the first embodiment, the first hinge part 1 moves together with the sleeve 6 relative to the second hinge part 2 in the axial direction. When for example a screw drive 31 is provided with a thread pitch of the threads 32, 33 of 1.5 mm, the resulting axial stroke between the hinge parts 1, 2 at a pivot angle of 90° is approximately 0.375 mm. For this reason, the sealing ring 22 that is provided between the radial collar 38 of the sleeve 6 and the housing 25 is elastic in the vertical direction in order to ensure in the end positions of the hinge parts 1, 2 a reliable sealing action of the interior of the housing 25. Such a sealing action is required in order to prevent the escape of lubricant 28 from the interior of the housing as well prevent penetration of dirt particles into the interior of the housing 25. Dry lubrication is also possible aside from the illustrated liquid lubrication.

REFERENCE NUMERALS

1 hinge part, door hinge part
2 hinge part, body hinge part
3 blocking device
5 sleeve
6 brake member, sleeve
7 friction surface
10 advancing direction
12 slide bushing
13 assembly, module
14 hinge shaft
15 surface
16 glide plate
17 screw
18 housing
19 truncated cone
20 nut
21 pawl pawl clutch
22 seal, sealing ring
23 nut
24 slot
25 housing
26 cam
27 recess
28 lubricant
29 securing ring
30 radial play
31 drive, screw drive, threaded drive
32 thread, first element of the drive
33 thread, second element of the drive
34 flange
35 fastening section
36 threaded bore
37 bore
38 radial collar
39 outer thread
40 seal, sealing ring
41 recess
42 pin
43 radial collar
F force
L1 first length section
L2 second length section
S pivot angle
A pivot axis

What is claimed is:

1. A pivot device comprising:

a first hinge part;

a second hinge part pivotably connected to the first hinge part about a pivot axis;

a blocking device comprising a first element with a friction surface and a second element with a second friction surface;

wherein first element is operatively connected to the first hinge part and the second element is operatively connected to the second hinge part;

a drive comprising a first thread associated with the first hinge part and a second thread associated with the second hinge part;

wherein, when pivoting the first and second hinge parts relative to one another from an initial position into a pivoted position, the first and second threads interact with each other such that the first and second friction surfaces glide across one another and move axially past each other in an axial direction of the pivot axis as a pivot angle between the first and second hinge parts increases;

wherein, as the pivot angle increases relative to the initial position, a friction force between the first and second friction surfaces increases and the friction force secures the first and second hinge parts relative to each other against accidental pivoting away from the pivoted position.

2. The pivot device according to claim 1, wherein in the axial direction of the pivot device the drive extends across a first length section and the first and second friction surfaces extend across a second length section, wherein the first and second length sections overlap one another partially in the axial direction.

3. The pivot device according to claim 1, wherein the first friction surface is axially movable while the second friction surface is axially fixed.

4. The pivot device according to claim 1, wherein the first friction surface is an inner cone and the second friction surface is a matching truncated cone that is gliding in the inner cone.

5. The pivot device according to claim 1, wherein the first and second hinge parts together with the blocking device form a commonly mountable assembly.

6. The pivot device according to claim 1, wherein the first element is a brake member that is axially movable relative to the first hinge part and relative to the second hinge part, wherein the first thread of the drive is provided on the brake member and the second thread is provided on the second hinge part.

7. The pivot device according to claim 6, wherein the brake member is a sleeve having an inner wall and an outer wall, wherein the first friction surface is provided on the inner wall and the first thread is provided on the outer wall, or the first friction surface is provided on the outer wall and the first thread is provided on the inner wall.

8. The pivot device according to claim 1, wherein the first friction surface is conical.

9. The pivot device according to claim 6, further comprising a pawl dutch connecting the brake member and the second hinge part.

10. The pivot device according to claim 6, wherein the first element is a first sleeve and the second element is a second sleeve.

11. The pivot device according to claim 10, wherein the second sleeve provided with the second friction surface in the form of a truncated cone has axial grooves or axial slots distributed about a circumference of the second sleeve.

12. The pivot device according to claim 1, wherein the first element is a first sleeve and the second element is a second sleeve that is fixed to the second hinge part and the first sleeve is movable relative to the second hinge part in the axial direction.

13. The pivot device according to claim 10, wherein the first and second sleeves are arranged in a cylindrical opening of the first hinge part or a cylindrical opening of the second hinge part.

14. The pivot device according to claim 1, wherein the first hinge part is a door hinge part, the second hinge part is a body hinge part, and the blocking device is a door catch for arresting a vehicle door relative to a body of a motor vehicle.

* * * * *